US005116294A

United States Patent [19]

Findlay

[11] Patent Number: 5,116,294

[45] Date of Patent: May 26, 1992

[54] STAIR CLIMBING EXERCISE APPARATUS

[75] Inventor: Nathanial B. Findlay, Quebec, Canada

[73] Assignee: Inside Fitness Inc., Ste Foy, Canada

[21] Appl. No.: 688,437

[22] Filed: Apr. 22, 1991

Related U.S. Application Data

[62] Division of Ser. No. 595,289, Oct. 10, 1990, Pat. No. 5,033,733.

[51] Int. Cl.[5] ..... A63B 23/04

[52] U.S. Cl. ..... 482/52; 482/127

[58] Field of Search ..... 272/69, 70, 129, 93, 272/72

[56] References Cited

U.S. PATENT DOCUMENTS 4,261,562 4/1981 Flavell ..... 272/129

4,938,474 7/1990 Sweeney et al. ..... 272/129

*Primary Examiner*—Stephen R. Crow

*Attorney, Agent, or Firm*—Foley & Lardner

[57] ABSTRACT

A frame structure mounts two side-by-side steps which are pivotally connected to the frame structure for up-and-down motion. The up-and-down motion of each step is translated to rotary motion by a first and second pulley. The first pulley is connected to the first step by a strap which has one end connected to the strap and the other end connected to the first pulley. The second pulley is connected to the second step by a second strap which has one end connected to the second step and the other end anchored to the second pulley.

1 Claim, 2 Drawing Sheets

STAIR CLIMBING EXERCISE APPARATUS

CROSS-REFERENCE TO RELATED APPLICATION

This application is a divisional of Application Ser. No. 595,289, filed Oct. 10, 1990, now U.S. Pat. No. 5,033,733.

BACKGROUND OF INVENTION

1. Field of the Invention

The invention relates to a stair climbing exercise apparatus. More specifically, the invention relates to such an apparatus wherein the up-and-down motion of the steps of the apparatus is translated to rotary motion, and the rotary motion is transmitted, by a planetary gear arrangement, to a resistance element which provides the exercise resistance.

2. Description of the Prior Art

Stairway exercise apparatus are known in the art as illustrated in, for example, U.S. Pat. No. 4,708,338, Potts, Nov. 24, 1987, U.S. Pat. No. 4,676,501, Hoagland et al, June 30, 1987, U.S. Pat. No. 4,720,093, Del Mar, Jan. 19, 1988, U.S. Pat. No. 4,600,187, Schenker, July 15, 1986, and U.S. Pat. No. 4,685,669, DeCloux, Aug. 11, 1987, and U.S. Pat. No. 4,949,993, Stark et al, Aug. 21, 1990.

The '338 patent teaches an apparatus in which each of the pedals operate independently. Each pedal drives a pedal sprocket, which, in turn, drives a drive sprocket. However, the pedal sprockets drive the drive sprocket only in one direction of travel of the respective pedal sprockets. The drive sprocket, through a transmission system, drives an alternator shaft, and the alternator provides the exercise resistance. The pedals are returned to a rest position by a spring.

In the exercise machine of the '501 patent, which includes foot pads, exercise is performed by shifting the weight of the user from one side to another. Electric motors raise and lower the foot pads.

The stair climbing exerciser of the '093 patent has two steps which are connected, via chains, to sprockets. The sprockets are connected, via one-way drivers, to a flywheel so that the flywheel is rotated only by rotation in one direction of the sprockets. The steps are interconnected for reciprocal motion so that when a user drives one of the steps downwardly, he simultaneously drives the other step upwardly. The sprockets are driven by chains 61 and 62 respectively. One end of chain 61 is attached to the right pedal and the other end is attached to the left pedal. In the same way, the one end of 62 is attached to the left pedal while the other end is attached to the right pedal.

The step arms of the steps of the stair climbing exerciser of the '187 patent are connected to either end of a braked rocker plate. The braked rocker plate provides the exercise resistance and also provides reciprocal movement of the two steps.

In the '669 patent, each step of a stair climbing exerciser is connected to the piston of a separate piston and cylinder arrangement. The piston and cylinder arrangements provide the exercise resistance. In addition, the piston and cylinder arrangements are interconnected to provide reciprocal movement of the steps.

In the '993 patent, a pulley wheel arrangement is used to drive a resistance element. In accordance with the invention, chains 30 and 42 illustrated in FIG. 1 of the '993 patent are replaced with straps 88, 98 and 114, 116 respectively as illustrated in FIG. 6 of the patent. In accordance with the teachings of the patent, two straps are mounted on each pulley wheel 90 and 112 of FIG. 6. Alternatively, a single strap could be used on each pulley wheel, however, in that case, the single strap would be anchored to its respective pulley wheel intermediate its two ends. In the embodiment illustrated in FIG. 6, one end of strap 114 is connected to one pedal and the other end is anchored to the pulley wheel 112. One end of strap 116 is also anchored to pulley wheel 112, and the other end of strap 116 is connected to a spring 120. In the same way, one end of strap 88 is connected to the other pedal and the other end of strap 88 is anchored to pulley wheel 90. One end of strap 98 is also anchored to pulley wheel 90 while the other end of strap 98 is attached to a separate spring. If straps 114 and 116 comprised a single strap, then one end of the single strap would be connected to a pedal and the other end to a spring. The single strap would be anchored, intermediate its two ends, to pulley wheel 112.

SUMMARY OF INVENTION

It is noted that none of the prior art apparatus consists of an arrangement wherein each pulley is attached to only one strap attached at one end thereof to the pulley.

It is therefore an object of the invention to provide a stair climbing exercise apparatus wherein the up and down motion of the stairs are translated to rotary motion by means of pulleys. A first pulley is connected to a first step, and a second pulley is connected to a second step. Each pulley is connected to its respective step by a single strap which is connected, at one end thereof, to the step and, at the other end thereof, to its respective pulley.

In accordance with a particular embodiment of the invention three is provided a stair climbing exercise apparatus, comprising:

a frame structure;

a first step and a side-by-side second step, said steps being pivotally connected to said frame structure for up-and-down motion thereof;

a first rotary member mounted on said frame structure adjacent said first step and a second rotary member mounted on said frame structure adjacent said second step;

a first strap means having one end connected to said first step and the other end connected to said first rotary member whereby, when said first step is moved from an upward to a downward position, said first rotary member is caused to rotate in one direction;

a second strap means having one end connected to said second step and the other end connected to said second rotary member whereby, when said second step is moved from an upward to a downward position, said second rotary member is caused to rotate in said one direction;

shaft means extending between said first rotary member and said second rotary member;

first connecting means connecting said first rotary member to one end of said shaft means such that said shaft means rotates with said first rotary member when said first rotary member rotates in said one direction and does not rotate with said first rotary member when said first rotary member rotates in an opposite direction;

second connecting means connecting said second rotary member to the other end of said shaft means such that said shaft means rotates with said second rotary member when said second rotary member rotates in said one direction and does not rotate with said second rotary member when said second rotary member rotates in said opposite direction;

an exercise resistance element;

means for transmitting rotation of said shaft means to said resistance element; and first spring means for returning said first step to an upward position, and second spring means for returning said second step to an upward position.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
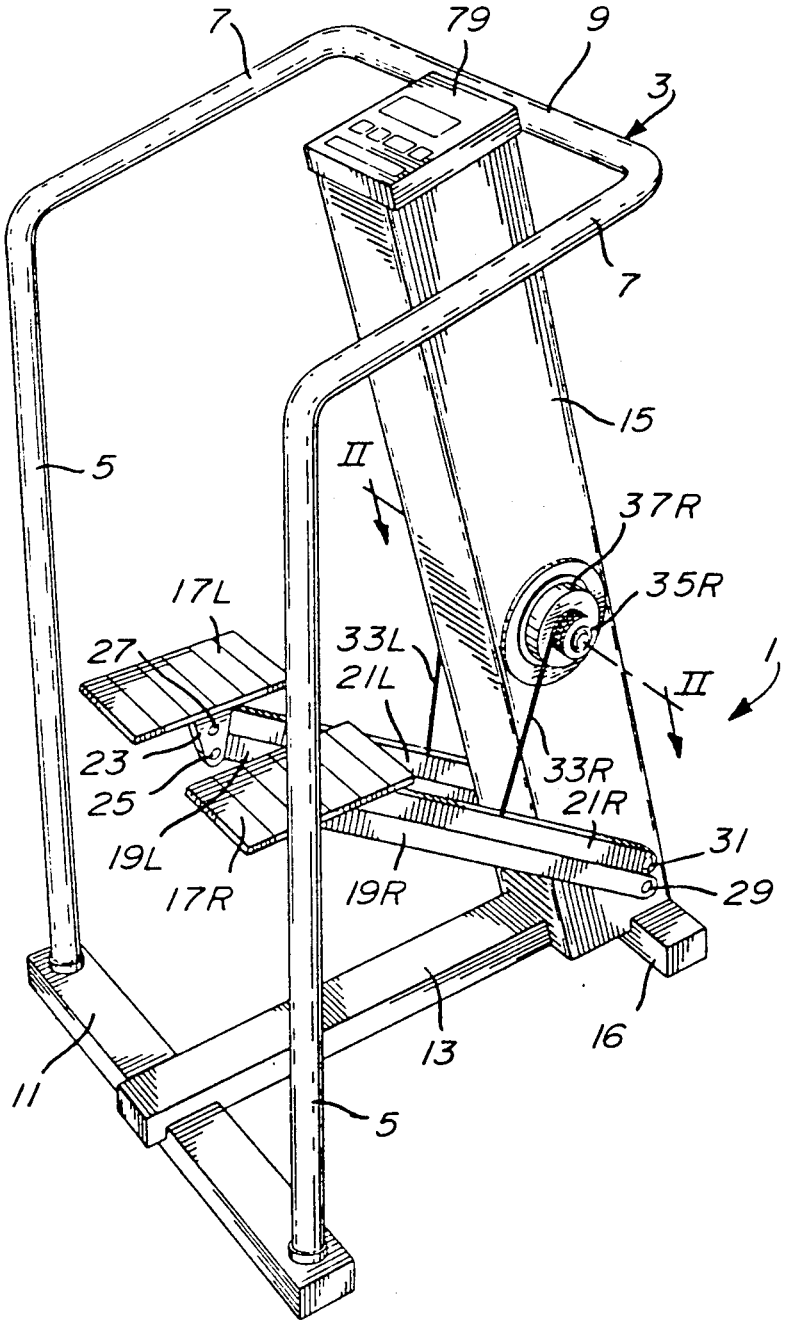
FIG. 1 is a perspective view of the stair climbing exercise apparatus in accordance with the invention.

Referring first to FIG. 1, the stair climbing exercise apparatus, illustrated generally at 1, comprises a tubular support member 3 having upright portions 5, horizontal portions 7 and a connecting bar 9. As illustrated in FIG. 1, the entire tubular support member can be formed as a single integral unit.

Disposed between the bottom ends of the upright portions 5 is a cross-horizontal floor member 11. Stabilizer 13 extends from the floor member 11 to the bottom end of a tubular stand 15 which also includes a cross-member 16.

A right pedal 17R and a left pedal 17L are connected to either side of the tubular stand 15 by parallel bars 19R, 21R and 19L, 21L respectively. Each pedal has an underlying tab 23, and the bars 19R, 21R and 19L, 21L are pivotally connected to the tab at points 25 and 27 respectively. The other ends of bars 19R, 21R and 19L, 21L are pivotally connected to either side of the tubular member at points 29 and 31 respectively. Accordingly, the steps can be moved upwardly, to an upward position as illustrated in FIG. 1, and downwardly to a downward position when the bars 19R, 21R and 19L, 21L are parallel to stabilizer member 13.

Connected to the right-hand parallel bars 19R, 21R and 19L, 21L are cables or straps 33R, 33L respectively. The straps 33R and 33L are wrapped around rotary members 35R and 35L (see also FIG. 2) which in the present embodiment constitute pulleys. The pulleys 35R and 35L are disposed adjacent spring covers 37R and 37L which, as seen in FIG. 2, house springs 39R and 39L respectively.

Figure 2:
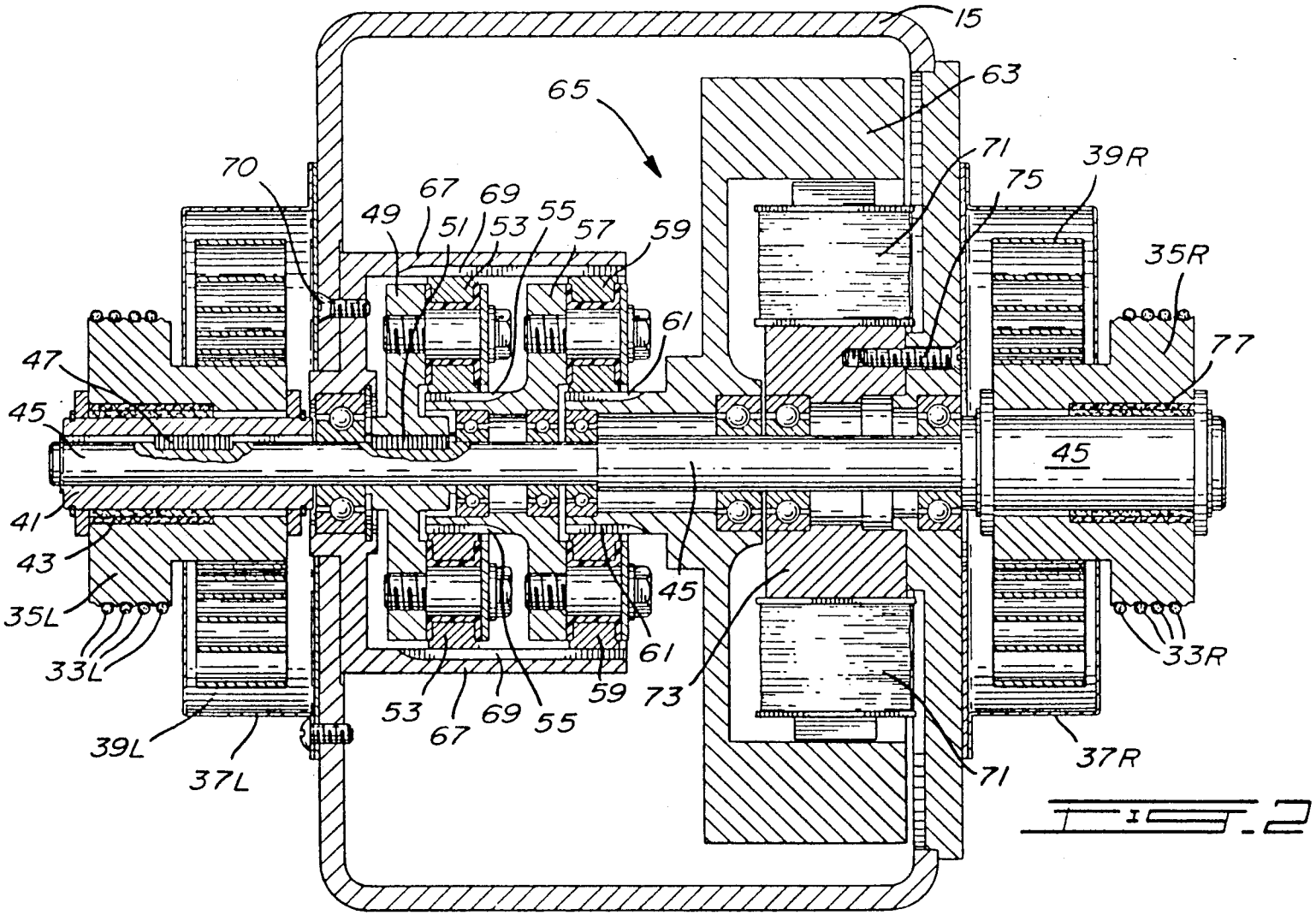
FIG. 2 is a section through II—II of FIG. 1 illustrating the planetary gear transmission system.

As seen in FIG. 2, pulley 35L is concentric with and surrounds a bushing 41. The bushing 41 is connected to the pulley 35L by one-way clutch 43. The one-way clutch will connect the bushing 41 to the pulley 35L when the pulley is rotated by a downward motion of the step 17L, i.e., in a counter-clockwise direction looking at the arrangement in FIG. 2 from the left-hand side.

Bushing 43 is connected to shaft 45 by keyway 47 so that shaft 45 will rotate with bushing 43.

Shaft 45 is connected to the carrier plate 49 of a first planetary gear arrangement by keyway 51 so that carrier plate 49 will rotate with the rotation of the shaft 45. Rotation of carrier plate 49 will cause pinions 53 (of which there are three in the planetary gear arrangement) to rotate, and the teeth of pinions 53 mesh with teeth 55 of the sun gear of the first planetary gear arrangement. The sun gear of the first planetary gear arrangement is connected to a carrier plate 57 of a second planetary gear arrangement which will thereby rotate with the rotation of the pinions 53 of the first planetary gear arrangement. This causes rotation of pinions 59 of the second planetary gear arrangement (which also includes three such pinion gears), and the teeth of the pinion gears 59 mesh with the teeth 61 of the sun gear of the second planetary gear arrangement. The sun gear of the second planetary gear arrangement is connected to a rotary member 63 of a resistance element illustrated generally at 65. In the illustrated embodiment, the resistance element 65 comprises an electromagnetic brake, and the rotary member 63 comprises the armature of the electromagnetic brake, which armature is in the shape of a short cylinder.

It is noted that the pinions 51 and 59 rotate in ring gear 67 which comprises the ring gear for both the first and second planetary gears. Specifically, the teeth of the pinions 51 and 59 mesh with the teeth 69 of the carrier 67. The carrier 67 is fixed to the tubular member 15 by bolt 70.

As is well known in the art, ring gear 67 is cylindrical in shape, and carrier plates 49 and 57 are circular and disposed co-axially with the cylindrical ring 67. The pinion gears are equally spaced around the carrier plates.

The electromagnetic brake comprises a plurality of bobbins 71 equally spaced around a pedestal 73 which comprises a short cylindrical member. The pedestal 73 is fixed to tubular member 15 by bolt 75.

Clutch 77 is disposed between pulley 35R and the right-hand end of the shaft 45. Clutch 77 will engage when downward motion of step 17R causes pulley 35R to rotate, i.e., once again, in the counterclockwise direction as seen from the left-hand side of FIG. 2. When the shaft rotates in the opposite direction, clutch 77 will slip.

Spring 39L is connected to pulley 35L so that the spring will be wound up when the pulley is rotated by the downward movement of step 17L, and will unwind when weight is removed from step 17L in its downward position to rotate pulley 35L in a clockwise direction to raise the step 17L to its upward position. Spring 39R is connected to pulley 35R in the same way. Thus, steps 17L and 17R will be raised from their downward to their upward position by the actions of springs 39L and 39R on pulleys 35L and 35R respectively.

In operation, the apparatus works as follows:

Assuming that the apparatus is in the state illustrated in FIG. 1, and an exerciser steps on step 17L, this will cause pulley 35L to rotate in the direction in which clutch 43 engages so that bushing 41 will rotate with the pulley 35L. Because of the connection between keyway 47 and shaft 45, shaft 45 will also rotate with the rotation of pulley 35L, and because of the connection between keyway 51 and carrier plate 49, carrier plate 49 will also rotate causing pinions 53 to rotate which, in turn, will cause carrier plate 57 to rotate. The rotation of carrier plate 57 will cause pinions 59 of the second planetary gear to rotate and this in turn will cause the armature 63 of the resistance element 65 to rotate. Armature 63 rotates against the braking force of the electromagnetic brake 65 thereby providing exercising resistance for the user.

At the same time, while pulley 35L is rotated, it will cause spring 39L to wind up. Clutch 77 will slip so that pulley 35R does not rotate with the rotation of shaft 45.

When step 17L reaches its downward position, the exerciser will place his foot, and his weight, on the upward step 17R. At this time, his weight will be removed from the step 17L, so that spring 39L will unwind pulling step 17L to its upward position.

When the exerciser steps on step 17R and puts his full weight thereon, then pulley 35R will be rotated by the action of cable 33R. With the pulley rotating in the direction caused by the downward movement of the step 17R, clutch 77 engages so that shaft 45 will rotate with pulley 35R. Again, the shaft 35 will be rotating in a counter-clockwise direction when looked at from the left-hand side in FIG. 2. At this time, clutch 43 will slip so that pulley 35L will not rotate with the rotation of shaft 45.

Once again, rotation of the shaft 45 will cause carrier plate 49 to rotate and, through the same train of action as above described, armature 63 of electromagnetic brake 65 will also rotate.

Accordingly, it can be seen that when a downward force is applied to either step 17L or step 17R, the linear motion will be translated to rotary motion by the respective pulley, and the rotary motion will be transmitted to the armature 63 of the electromagnetic brake 65. The armature will rotate against the braking force of the electromagnetic brake to thereby cause resistance for the exerciser to overcome.

It will also be seen that the pedals act independently of each other in accordance with the teachings of the present invention.

The bobbins 71 comprise mandrels with a single wire wound therearound. Both ends of the wires of all of the bobbins are connected, in parallel, to a source of current, and the magnitude of resistance offered by the inventive apparatus can be varied by varying the current applied to the bobbins. As is well known, varying the current will vary the magnetic field which causes the braking action.

The current will be made variable by activating appropriate switches of a control panel 79 illustrated in FIG. 1. The control panel would also include a read-out indicator to indicate, amongst other things, the resistance at which the apparatus is presently set. Other read-outs, as is well known in the art, can also be presented on the control panel.

As is well known in the art, the purpose for using a planetary gear arrangement is to provide an increase in rotary speed. Thus, the rotary speed of armature 63 will be greater than the rotary speed of pulleys 35R or 35L which causes the armature 63 to rotate. In the present embodiment, two carrier plates are illustrated. However, as is quite apparent, teeth 61 could be disposed to engage with the teeth of pinion gears 53 so that a second carrier plate would not be needed. Alternatively, the planetary gear arrangement could include three carrier plates if such an increase in speed is required.

In addition, although in the preferred embodiment there is a bushing 41 between pulley 35L and shaft 45, and contact between pulley 35R and shaft 45 is direct (through clutch 77), obviously, there could be bushings at both ends of the shaft, or there could be direct contact between the pulleys and the shaft at both ends. Again, the bushing could be placed at the righthand end and the left-hand end could include direct contact between pulley 35L and the left-hand end of the shaft 45.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A stair climbing exercise apparatus, comprising:

a frame structure;

a first step and a side-by-side second step, said steps being pivotally connected to said frame structure for up-and-down motion thereof;

a first rotary member mounted on said frame structure adjacent said first step and a second rotary member mounted on said frame structure adjacent said second step;

a first strap means having one end connected to said first step and the other end connected to said first rotary member whereby, when said first step is moved from an upward to a downward position, said first rotary member is caused to rotate in one direction;

a second strap means having one end connected to said second step and the other end connected to said second rotary member whereby, when said second step is moved from an upward to a downward position, said second rotary member is caused to rotate in said one direction;

shaft means extending between said first rotary member and said second rotary member;

first connecting means connecting said first rotary member to one end of said shaft means such that said shaft means rotates with said first rotary member when said first rotary member rotates in said one direction and does not rotate with said first rotary member when said first rotary member rotates in an opposite direction;

second connecting means connecting said second rotary member to the other end of said shaft means such that said shaft means rotates with said second rotary member when said second rotary member rotates in said one direction and does not rotate with said second rotary member when said second rotary member rotates in said opposite direction;

an exercise resistance element;

means for transmitting rotation of said shaft means to said resistance element; and first spring means for returning said first step to an upward position, and second spring means for returning said second step to an upward position;

said first rotary member comprising a first pulley and said second rotary member comprising a second, spaced, parallel pulley;

said first connecting means comprising a bushing connected to said one end of said shaft by a keyway;

said first pulley being connected to said bushing by a first one-way clutch;

said resistance element comprising an electromagnetic brake having a rotatable armature;

said rotatable armature of said electromagnetic brake comprising a short cylinder disposed parallel to said first and second pulleys and co-axial therewith;

a circular pedestal mounted within said armature and co-axial therewith;

a plurality of bobbins equally spaced around said pedestal;

said second connecting means comprising a second one-way clutch between the second end of said shaft means and said second pulley;

said first spring means being connected to said first pulley such that said first spring means winds up when said first pulley is rotated in said one direction, and, wherein, when said first spring means upwinds, it rotates said pulley in said opposite direction; and said second spring means being connected to said second pulley such that said second spring means winds up when said second pulley is rotates in said one direction, and, wherein, when said second spring means unwinds, it rotates said pulley in said opposite direction.

* * * * *